US005235373A

United States Patent [19]

Tanaka

[11] Patent Number: 5,235,373

[45] Date of Patent: Aug. 10, 1993

[54] FILM HOLDER FOR DENTAL X-RAY FILM DEVELOPING MACHINE, AND FILM MOUNTING STAGE FOR THE HOLDER

[75] Inventor: Hiroyuki Tanaka, Yokohama, Japan

[73] Assignee: Nix Company, Ltd., Tokyo, Japan

[21] Appl. No.: 742,425

[22] Filed: Aug. 8, 1991

[30] Foreign Application Priority Data

Aug. 13, 1990 [JP] Japan ..... 2-84567[U]

[51] Int. Cl.[5] ..... G03D 13/14

[52] U.S. Cl. ..... 354/344

[58] Field of Search ..... 354/311, 312, 315, 316, 354/319, 320, 322, 331, 337, 338-340, 345, 344

[56] References Cited

U.S. PATENT DOCUMENTS 3,882,527 5/1975 Sawada et al. ..... 354/322
4,125,852 11/1978 Brooks ..... 354/322
4,397,536 8/1983 Zwettler ..... 354/322

FOREIGN PATENT DOCUMENTS 0309617 4/1989 European Pat. Off. .

*Primary Examiner*—D. Rutledge

*Attorney, Agent, or Firm*—Wegner, Cantor, Mueller & Player

[57] ABSTRACT

A film holder is described for use in a dental X-ray film developing machine. The film holder has a stem portion, an engagement portion formed at one end of the stem portion a film-mounting portion composed of two support portions formed at the other end of the stem portion and extending out in an opposing relationship from the stem portion. Plural film-mounting projections are provided at different levels in the direction of the thickness of the film holder in the proximity of each of free end portions and base portions of the respective support portions, whereby a film can be placed between the support portions while being held between the projections. Also described is a film mounting stage for mounting a film on the film holder. The stage has a wall for placing the film thereon and film pressers extending from individual peripheral edges of the wall in correspondence to the respective sides of the film, and defines a film-holder-receiving recess having substantially the same shape in plan as the film holder and a bottom wall located lower than the wall.

2 Claims, 5 Drawing Sheets

FILM HOLDER FOR DENTAL X-RAY FILM DEVELOPING MACHINE, AND FILM MOUNTING STAGE FOR THE HOLDER

BACKGROUND OF THE INVENTION

1) Field of the Invention

This invention relates to a film holder for use in a dental X-ray film developing machine adapted to develop exposed dental X-ray films and also to a film mounting stage for the film holder.

2) Description of the Related Art

X-ray pictures of teeth have been used for the diagnosis and treatment of teeth in recent years. X-Ray photography of a tooth for obtaining its X-ray picture is effected by bringing an opaque dental X-ray film package, which contains an X-ray film sealed therein, into a diseased part within a mouth and then exposing the X-ray film to X-rays through the diseased part. By this X-ray photography, a latent image of the tooth is formed on the X-ray film.

After completion of the X-ray photography, the X-ray film package is taken out of the mouth and is then opened in a dark room to take out the X-ray film. The X-ray film thus taken out is processed for its development, for example, is developed, fixed and washed, whereby an X-ray picture of the thus-taken tooth is obtained on the X-ray film.

In order to easily conduct the above development processing without much labor, automatic developing machines have been proposed including, for example, the automatic developing machine disclosed in Japanese Utility Model Application Laid-Open (Kokai) No. SHO 63-58237 laid open on Apr. 18, 1988. This developing machine will hereinafter be described with reference to some of the accompanying drawings.

FIG. 1 is a plan view of the above dental X-ray film developing machine, FIG. 2 is a cross-sectional view taken along line II—II of FIG. 1. In these drawings, numeral 1 indicates the automatic dental X-ray film developing machine. There are shown a circular bottom wall 2*a*, a cylindrical outer peripheral wall 2*b* provided upright from the peripheral edge of the bottom wall 2*a*, and a cylindrical inner peripheral wall 2*c* provided at a predetermined interval inside the outer peripheral wall 2*b*. An annular and groove-like space is formed by the bottom wall 2*a*, outer peripheral wall 2*b* and inner peripheral wall 2*c*. Designated at symbols 3*a*,3*b*,3*c*,3*d* are partition walls provided radially between the outer peripheral wall 2*b* and the inner peripheral wall 2*c*. The individual partition walls 3*a*–3*d* are arranged at predetermined intervals. Owing to the provision of the partition walls 3*a*–3*d*, the annular space has been divided into four compartments 4*a*,4*b*,4*c*, 4*d*. Numeral 5 indicates a motor mounted on the bottom wall 2*a* inside a cylindrical space formed by the bottom wall 2*a* and the inner peripheral wall 2*c*. The drawings also illustrate a rotary shaft 6 connected to the motor 5 either directly or via a reducing gear unit, not shown, an arm 7 fixed at one end thereof on the rotary shaft 6 and extending radially from the rotary shaft 6, and a suspending portion 7*a* formed at the opposite, namely, free end of the arm 7. The free end, namely, the suspending portion 7*a* of the arm 7 is positioned above the annular space and approximately at the mid-point between the outer peripheral wall 2*b* and the inner peripheral wall 2*c*. Designated at symbols 8*a*,8*b*,8*c* are plugs closing their corresponding discharge openings formed through lower parts of the peripheral outer walls 2*b* of the respective compartments 4*a*,4*b*,4*c*. Numeral 10 indicates a holder as a film-mounting member, which is adapted to support a dental X-ray film thereon. The structure of the holder 10 will next be described with reference to FIGS. 3(A) and 3(B).

FIG. 3(A) is a plan view of the holder shown in FIG. 2, and FIG. 3(B) is a cross-sectional view of the holder taken along line III(B)—III(B) of FIG. 3(A). The holder 10 is composed of a main body 10*a*, a hole 10*b* formed through one end portion of the main body 10*a*, and a film-mounting portion 10*c* formed at the other end portion of the main body 10*a*. The film-mounting portion 10*c* is bifurcated as depicted in FIG. 3(A). By inserting both sides of a dental X-ray film F into the corresponding slots 10*d*,10*d* from the free end of the film-mounting portion 10*c*, the dental X-ray film F is supported on the holder 30.

Development processing by the developing machine 1 is conducted in the following manner. First of all, the compartments 4*a*,4*b*,4*c* are filled with a developer, a fixer and a washing liquid, respectively, and a heater is provided in the compartment 4*d*. The motor 5 is driven with the holder 10, on which the film F is supported, being suspended from the arm 7. As a result, the arm 7 is rotated so that the film F is allowed to successively pass through the developer, the fixer and the washing liquid and is then dried.

After passage through the compartment 4*d*, the holder 10 is detached from the arm 7 and the dental X-ray film F is removed from the film mounting portion 10*c* of the holder 10. The development processing of the dental X-ray film F has now been completed, so that an X-ray picture of a tooth is shown there.

The developing machine 1 is suited to easily develop exposed dental X-ray films by a dentist or his assistant in his office, and is usually installed and used in a bright room rather than a dark room. Upon processing for development, the dentist or the like takes out the exposed dental X-ray film package from the mouth of the patient. Inside a dark box connected to the above developing machine 1, the covering of the dental X-ray film package is opened to take out the film F and, after mounting the film F on the film-mounting portion 10*c* of the holder 10, the holder 10 is attached to the arm 7.

The above procedures are all carried out in the dark box so that they have to be done by feel. They are hence extremely cumbersome work for those unskilled, resulting in the problems that the above procedures require both labor and time.

SUMMARY OF THE INVENTION

An object of the present invention is to overcome the above-described problems of the conventional art, and to provide a film holder for a dental X-ray film developing machine, said film holder permitting easy work such as mounting of films, and also a film mounting stage for the film holder.

In a first aspect of the present invention, there is thus provided a film holder for a dental X-ray film developing machine in which the film holder with a film mounted thereon is brought into engagement with an arm attached to a rotary shaft and development of the film is conducted while the rotary shaft makes a full turn. The film holder comprises a stem portion having opposite ends, an engagement portion formed at one end of the stem portion and engageable with the arm and a film-mounting portion composed of two support portions formed at the other end of the stem portion and extending out in an opposing relationship from the stem portion. Plural film-mounting projections are provided at different levels in the direction of the thickness of the film holder in the proximity of each of free end portions of the respective support portions and base portions of the respective support portions, whereby the film can be placed between the support portions while being held between the film-mounting projections.

In a second aspect of the present invention, there is also provided a film mounting stage for mounting a film on the above film holder. The film mounting stage comprises a wall for placing the film thereon and film pressers extending from individual peripheral edges of the wall in correspondence to the respective sides of the film, and defines a film-holder-receiving recess having substantially the same shape in plan as the film holder and a bottom wall located lower than the wall.

A dentist or the like takes out the film from a dental X-ray film package in a dark box, and places the film on the film-placing wall of the film mounting stage arranged inside the dark box. Here, the film is held at a predetermined position by the film pressers. The dentist or the like then fits the film holder in the film-holder-receiving recess. This fitting can be effected easily and precisely as the film-holder-receiving recess is formed in substantially the same shape as the film holder. The engagement portion of the film holder with the film mounted thereon as described above is thereafter brought into engagement with the rotatable arm by the dentist or the like. The film holder and film mounting stage according to the present invention can therefore facilitate development processing by a dentist or the like.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 4A:
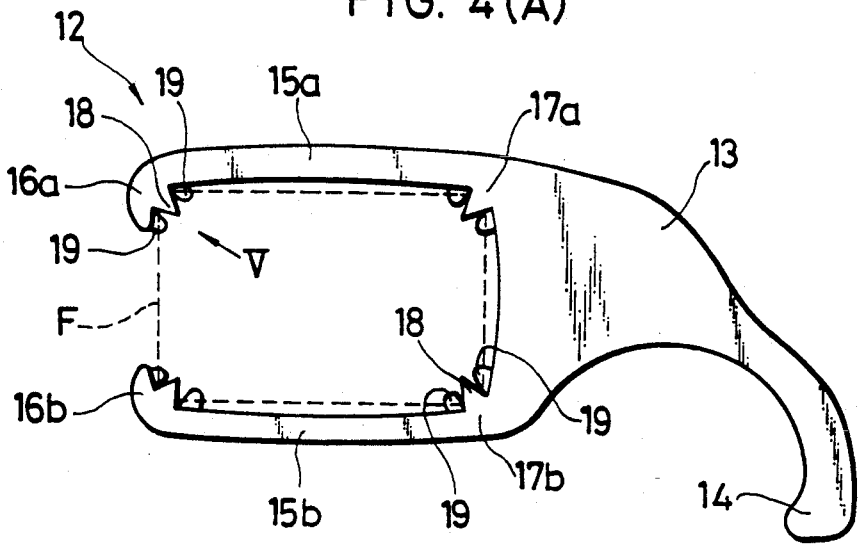
FIG. 4(A) is a plan view of a film holder according to a first embodiment of the first aspect of the present invention.
Figure 5:
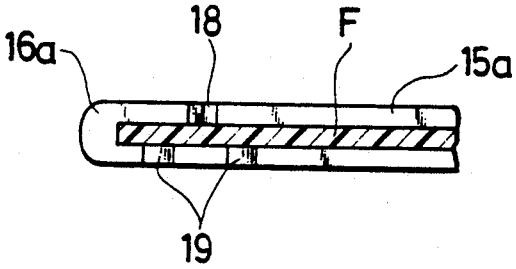
FIG. 5 is a fragmentary side view of the film holder of FIG. 4(A), as viewed in the direction of arrow V.
Figure 6A:
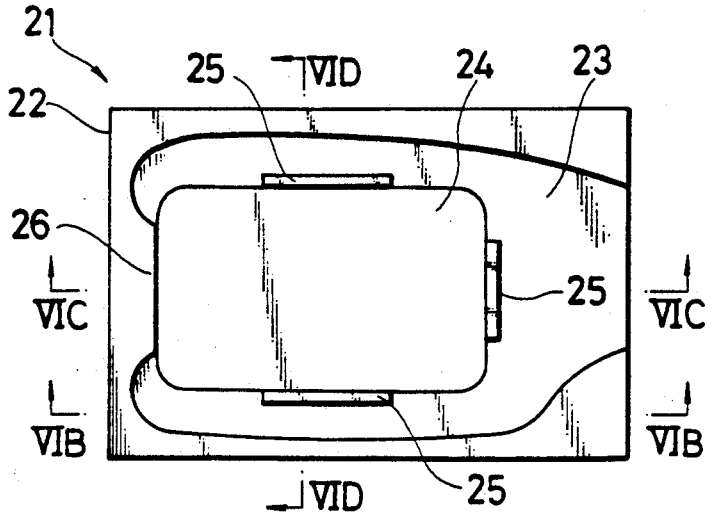
FIG. 6(A) is a plan view of a film mounting stage according to one embodiment of the second aspect of the present invention.
Figure 6B:
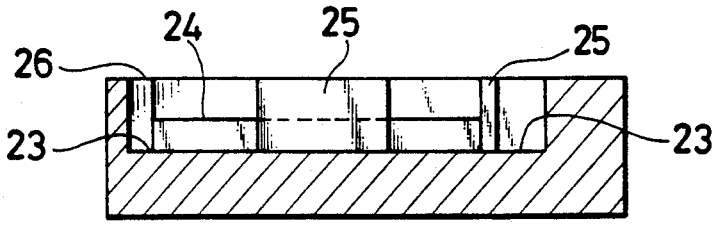
FIG. 6(B) is a cross-sectional view of the film mounting stage of FIG. 6(A), taken along line VI(B)—VI(B)
Figure 6C:
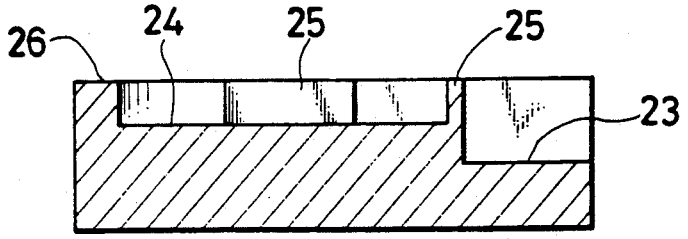
FIG. 6(C) is a cross-sectional view of the film mounting stage of FIG. 6(A), taken along line VI(C)—VI(C)
Figure 6D:
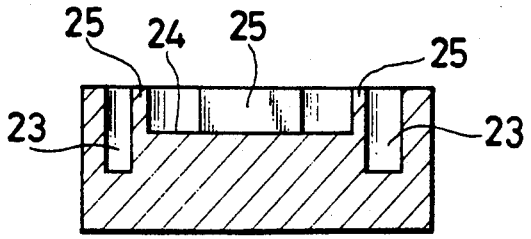
FIG. 6(D) is a cross-sectional view of the film mounting stage of FIG. 6(A), taken along line VI(D)—VI(D)

Referring first to FIG. 4(A) and FIG. 5, numeral 12 indicates the film holder according to the first embodiment of the first aspect of the present invention. There are also shown a stem portion 13 of the film holder 12, a hook 14 formed at one end of the stem portion 13, and film support portions **15*a*,15*b* extending out in a mutually-bifurcated relationship from the other end of the stem portion 13. Designated at symbols 16*a*,16*b* are free end portions of the respective film support portions 15*a*,15*b*, whereas designated at symbols 17*a*,17*b* are base portions of the respective film support portions 15*a*,15*b***.

Numeral 18,19 indicates projections for holding the film F, said projections being formed at each of the free end portions **16*a*,16*b* and the base end portions 17*a*,17*b*. At each location, one projection 18 and two projections 19 are provided. The individual projections 18,19 extend into a space surrounded by the two film support portions 15*a*,15*b*. At each location, the projection 18 and its associated projections 19 are formed at different levels in the direction of the thickness of the film holder 12** so that the film F can be held therebetween.

Figure 3:
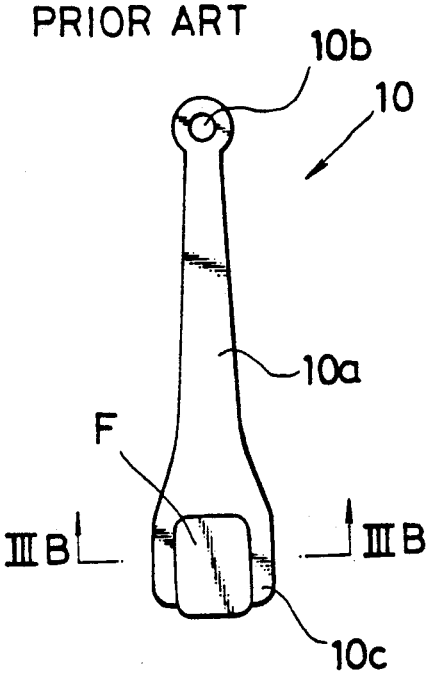
FIG. 3 (A) PRIOR ART
FIG. 3(A) is a plan view of a film holder depicted in FIG. 1.
FIG. 3(B) is a cross-sectional view of the film holder of FIG. 3(A), taken along line III(B)—III(B)
Figure 3:
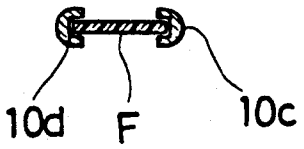
FIG. 3 (B) PRIOR ART

The hook 14 protrudes out by a predetermined dimension from an imaginary line which axially passes through one of the film support portions **15*a*,15*b* (the film support portion 15*b* in the illustrated embodiment). This hook 14 is a portion corresponding to the hole 10*b* shown in FIG. 3(A). In the present embodiment, the hook 14 is provided to hook the film holder 12 on the suspending portion 7*a* of the arm 7**.

Figure 4B:
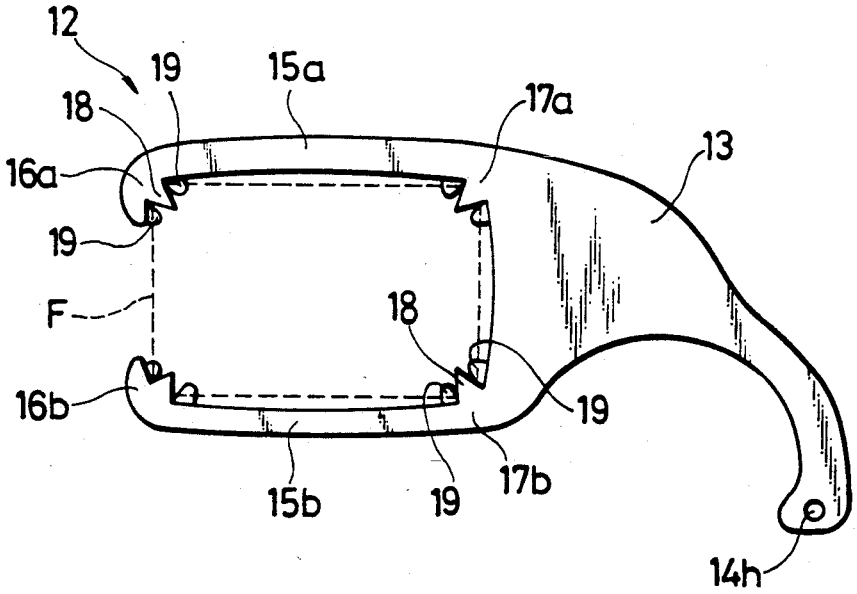
FIG. 4(B) is a plan view of a film holder according to a second embodiment of the first aspect of the present invention.

The film holder shown in FIG. 4(B) is different from that illustrated in FIG. 4(A) in that the latter film holder has the hook 14 but the former film holder defines an attachment hole **14*h* in one end of the stem portion 13**. The remaining construction of the film holder of FIG. 4(B) is identical to that of the film holder of FIG. 4(A).

With reference to FIGS. 6(A) to 6(D), the construction of the stage for mounting the film F on the film holder 12 will next be described. In the drawings, numeral 21 indicates the mounting stage. Designated at numerals 22 and 23 are a block forming the mounting stage and a recess formed in the block 22, respectively. The recess 23 is formed in substantially the same shape as the film support portions **15*a*,15*b* and a part of the stem portion 13 of the film holder 12 illustrated in FIGS. 4(A) and 4(B), and has dimensions slightly larger than the latter. Numeral 24 indicates a wall on which the film F is placed. The wall 24 is located at a level higher than a bottom wall of the recess 33. Designated at numeral 25 are film pressers extending upwardly from three sides of the film placing wall 24, respectively. Numeral 26 indicates a portion of the block 22, which is in contact with the remaining side of the film placing wall 24 and, as will be described, has the same function as the film pressers 25. The film mounting stage 21** is arranged inside the dark box in which the film F is taken out of the dental X-ray film package.

A description will next be made of a film mounting operation in which the film holder and film mounting stage according to the present invention will be used. The exposed dental X-ray film package is opened by feel within the dark box so that the film F is taken out.

The film F so taken out is placed on the film placing wall 24. The thus-placed film F is positioned owing to the provision of the film pressers 25 and the block portion 26, so that no dislocation takes place.

In this state, the film holder 12 is then fitted in the recess 23. Since the recess 23 is formed in substantially the same shape as the film holder 12, the film holder 12 is not fitted in a wrong direction. As the film holder 12 is being progressively fitted, corner portions of the film F is brought into contact with the projections 19 at all the four locations before the film holder 12 reaches the bottom wall of the recess 23. Further downward pressing of the film holder 12 toward the bottom wall causes the film F to be flexed by the projections 19. When the film holder 12 is depressed further in this state, the thus-flexed corner portions of the film F are allowed to pass beyond the projections 19. The corner portions then flex back into their planar positions and come to contact with the projections 18. At this time, the film holder 12 has reached substantially the bottom wall of the recess 23.

Figure 7:
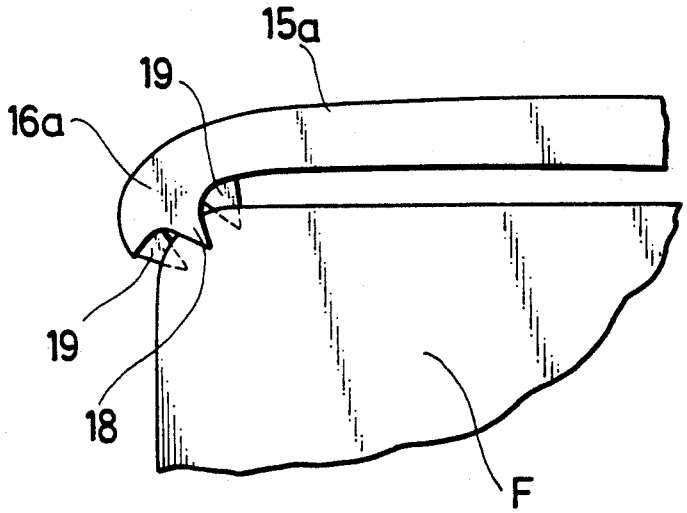
FIG. 7 is a view of a film support portion of the film holder of FIG. 4(A) and a portion of a film mounted thereon.

The film F and a portion of the film support portion 15*a* at this time are illustrated in plan in FIG. 7. As is apparent from the drawing, the film F is mounted on the film holder 12 while being held between each projection 18 and its associated projections 19,19. Accordingly, the dentist or the like can mount, with extreme ease, the film F on the film holder 12 by the simple operation, namely, by simply depressing and fitting the film holder 12 into the recess 23.

Figure 1:
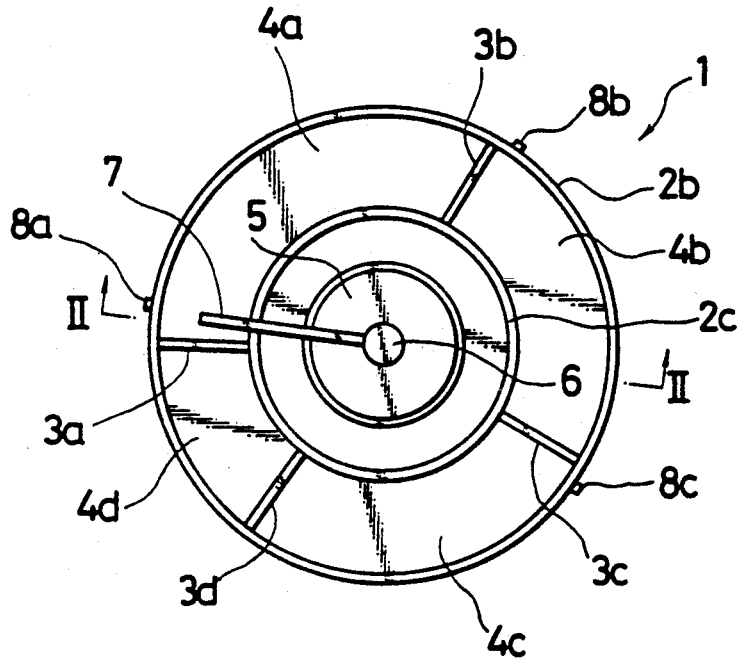
FIG. 1 PRIOR ART
FIG. 1 is a plan view of a conventional dental X-ray film developing machine.
Figure 2:
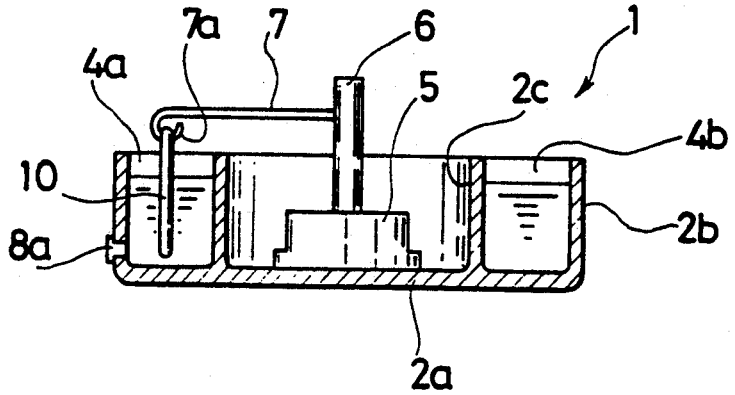
FIG. 2 PRIOR ART
FIG. 2 is a cross-sectional view of the developing machine shown in FIG. 1.

Within the dark box, the dentist or the like then either puts the hook 14 of the film holder 12, on which the film F has been mounted as described above, on the arm 7 shown in FIGS. 1 and 2 or causes the arm 7 to extend through the attachment hole 14*h* of the film holder 12, whereby the film holder 12 is allowed to pass through the individual compartments 4*a*–4*d* while being dragged by the arm 7. During this period of time, the development processing of the film F is carried out.

The above development processing can be automated by positioning the hook 14 or attachment hole 14*h* on the track of movements of the arm 7.

What is claimed is:

1. In a film holder for a dental X-ray film developing machine in which the film holder with a film mounted thereon is brought into engagement with an arm attached to a rotary shaft and development of the film is conducted while the rotary shaft makes a full turn, the improvement wherein said film holder comprises a stem portion having opposite ends, an engagement portion formed at one end of the stem portion and engageable with the arm and a film-mounting portion composed of two support portions formed at the other end of the stem portion and extending out in an opposing relationship from the stem portion; and plural film-mounting projections are provided at different levels in the direction of a thickness of the film holder in the proximity, of each of a free end portion of the respective support portions and a base portion of the respective support portions, whereby the film can be placed between the support portions while being held between the film-mounting projections.

2. A film mounting stage for mounting a film on a film holder for a dental X-ray film developing machine in which the film holder with a film mounted thereon is brought into engagement with an arm attached to a rotary shaft and development of the film is conducted while the rotary shaft makes a full turn, said film holder comprising a stem portion having opposite ends, an engagement portion formed at one end of the stem portion and engageable with the arm and a film-mounting portion composed of two support portions formed at the other end of the stem portion and extending out in an opposing relationship from the stem portion; and plural film-mounting projections are provided at different levels in the direction of a thickness of the film holder in the proximity of each of a free end portion of the respective support portions and a base portion of the respective support portions, whereby the film can be placed between the support portions while being held between the film-mounting projections, said film mounting stage comprising a wall for placing the film thereon and film pressure extending from individual peripheral edges of the wall in corresponding to the respective sides of the film and defines a film-holder-receiving recess having substantially the same shape when viewed from above as the film holder and a bottom wall located lower than the wall.

* * * * *